US008353074B2

(12) United States Patent
Krebs

(10) Patent No.: US 8,353,074 B2
(45) Date of Patent: Jan. 15, 2013

(54) STEAM MOP WITH SHUTTLING STEAM DISTRIBUTOR

(75) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 228 days.

(21) Appl. No.: 12/959,963

(22) Filed: Dec. 3, 2010

(65) Prior Publication Data

US 2011/0131753 A1 Jun. 9, 2011

Related U.S. Application Data

(60) Provisional application No. 61/266,285, filed on Dec. 3, 2009.

(51) Int. Cl.
*A47L 11/30* (2006.01)

(52) U.S. Cl. ..... 15/98; 15/320; 15/322; 15/339; 15/354; 15/416

(58) Field of Classification Search ..... 15/51, 320–322, 15/328, 339, 354, 416, 98; *A47L 11/30*
See application file for complete search history.

(56) References Cited

U.S. PATENT DOCUMENTS 4,433,451 A 2/1984 Parisi
2004/0111822 A1 6/2004 Syu

FOREIGN PATENT DOCUMENTS

| | | | |
|---|---|---|---|
| EP | 0684006 | A1 | 5/1995 |
| EP | 1654973 | A1 | 5/2006 |
| JP | 7327878 | A | 12/1995 |
| JP | 8140905 | A | 6/1996 |
| JP | 2006255148 | A | 9/2006 |
| KR | 20000000271 | A | 1/2000 |
| WO | 9827856 | A1 | 7/1998 |
| WO | 02085174 | A1 | 10/2002 |
| WO | 2005011461 | A1 | 2/2005 |

*Primary Examiner* — David Redding
(74) *Attorney, Agent, or Firm* — McGarry Bair PC

(57) ABSTRACT

A surface cleaning apparatus, and in particular a steam mop, comprises a steam delivery system for generating and distributing steam onto a surface to be cleaned. The steam mop further comprises a handle assembly mounted to a foot assembly that has a shuttling plate slidably mounted beneath the foot assembly, wherein the shuttle plate is configured to selectively divert steam through one of a pair of steam distributors positioned at a forward and rearward portion of the foot assembly dependent on the cleaning stroke direction of the steam mop. In one embodiment, the surface cleaning apparatus further comprises a vacuum source mounted thereto and at least one suction nozzle connected to the vacuum source and adapted to contact the surface to be cleaned and to draw moisture and debris from the surface.

13 Claims, 7 Drawing Sheets

STEAM MOP WITH SHUTTLING STEAM DISTRIBUTOR

CROSS-REFERENCE TO RELATED APPLICATION

This application claims the benefit of U.S. Provisional Patent Application No. 61/266,285 filed Dec. 3, 2009, which is incorporated herein by reference in its entirety.

BACKGROUND OF THE INVENTION

1. Field of the Invention

This invention relates to a surface cleaner. In one of its aspects, the invention relates to an upright bare floor steam cleaner. In another aspect, the invention relates to a bare surface cleaner that performs steam mopping. In another aspect, the invention relates to a steam cleaner configured to distribute steam at the leading edge of a steam pad on both forward and back strokes. In still another aspect, the invention relates to a bare surface cleaner that simultaneously performs steam mopping and vacuuming. In yet another aspect, the invention relates to a steam vacuum foot that selectively directs steam to a leading edge on both forward and back strokes while simultaneously applying continuous suction in front and rear portions of the foot.

2. Description of the Related Art

Steam mops are well known devices for cleaning bare floor surfaces, such as tile, linoleum, vinyl, laminate, and hardwood floors. Typical steam mops have a reservoir for storing water that is fluidly connected to a selectively engagable pump or valve. The pump or valve outlet is fluidly connected to a steam boiler with a heating element to heat the water. The steam boiler generates steam, which is directed towards the cleaning surface through a nozzle or manifold mounted in the foot. Steam is typically applied to the backside of a mop pad attached to the foot. Steam vapor eventually saturates the entire pad as the moisture wicks outwardly from the point of steam application. The damp pad is wiped across the surface to be cleaned to remove dirt, dust, and debris present on the cleaning surface.

A bare floor cleaner has heretofore been sold in the United States by BISSELL Homecare, Inc. under the mark Steam Mop. The Steam Mop bare floor cleaner comprises a base assembly and an upright handle pivotally mounted to the base assembly. The base assembly includes a base housing with a fluid distributor for distributing fluid to the surface to be cleaned; and a mop pad that is affixed beneath the base housing and positioned for contacting the surface to be cleaned. The upright handle includes a handle housing; a water tank mounted to the handle housing and adapted to hold a quantity of water; a fluid distribution system between the water tank and the base housing fluid distributor for distributing fluid from the water tank to the mop pad for applying the steam to the surface to be cleaned; and a heating element within the fluid distribution system for heating the water from the water tank to steam.

During use, the mop pad eventually becomes saturated with liquid and soiled with embedded dirt, dust, and debris. The soiled mop pad can be laundered and re-used. A mop pad can generally be used for one or two steam mopping sessions prior to being laundered.

JP07327878A2 to Iwao discloses a vacuum nozzle with a slidably supported mop plate mounted beneath the nozzle. A mop cloth is detachably fixed to the sliding mop plate. During use, the mop plate slides back and forth thereby alternately opening a suction port at the leading edge of the mop cloth affixed to the mop plate. An outer frame can maintain a minimum vertical clearance between the nozzle and a floor surface.

PCT application WO 05/011461A1 to Hahn discloses a steam cleaner with vacuum function. The device comprises a foot with a vacuum unit at a front section and a steam delivery and agitation unit at a rearward section. The steam delivery and agitation unit comprises rotating agitation plates mounted at the bottom of the foot. The agitation plates rotate about a vertical axis and further comprise steam delivery ports therein.

U.S. Patent Application Publication No. 2004/0111822 to Syu discloses a steam vacuum having dual suction inlets arranged transversely on the leading and trailing side of an elongate steam delivery nozzle.

SUMMARY OF THE INVENTION

The invention relates to a surface cleaning apparatus, and more particularly to a steam mop, comprising a foot assembly for movement along a surface to be cleaned and a handle assembly mounted to the foot assembly. The steam mop further comprises a steam delivery system mounted at least in part to the foot assembly and includes a steam generator and a forward and a rearward steam distributor connected to the steam generator, wherein the forward and rearward steam distributors are positioned at a forward portion and a rearward portion, respectively, of the foot assembly. Further, a shuttle plate is mounted to the foot assembly for reciprocal movement between a forward position in registry with the forward steam distributor and a rearward position in registry with the rear steam distributor on an underside of the foot assembly. The shuttle plate is configured to close off the forward steam distributor at the forward position and to close off the rearward steam distributor when the shuttle plate is in the rearward position, whereby the rearward steam distributor is open when the shuttle plate is in the forward position and the forward steam distributor is open when the shuttle plate is in the rearward position.

In one embodiment of the invention, the handle assembly is swivelably mounted to the foot assembly.

In another embodiment of the invention, the steam delivery system further comprises a fluid supply tank fluidly connected to the steam generator for supplying cleaning fluid to the steam generator.

In yet another embodiment of the invention, the steam distributors extend across at least a substantial portion of the foot assembly. Additionally, the steam distributors can comprise one of a narrow slit-opening, a plurality of small apertures or slits, cat-eye openings, or the like. The steam distributor forms a portion of a manifold that has a central opening that is connected to the steam generator. The manifold has an X-shaped channel connecting the central opening to the forward and rearward steam distributors.

In one embodiment of the invention, the shuttle plate is adapted to removably mount a cleaning implement, such as a mop cloth, scrubbing pad, scrub brush, or cleaning sheet. The shuttle plate comprises one of a hook and loop fasteners, elastic straps, adhesive strips, resilient cloth engagement and retention members having radiating slits for removably attaching the cleaning implement to the surface cleaner.

In another embodiment, the shuttle plate has a pair of outwardly extending projections and the foot assembly has a pair of guide tracks in which the projections are glidingly received.

In yet another embodiment, the surface cleaner further comprises a vacuum source mounted to at least one of the foot assembly and the handle assembly, wherein the foot assembly includes at least one suction nozzle connected to the vacuum source and adapted to contact the surface to be cleaned and to draw moisture and debris from the surface. The at least one suction nozzle includes a suction nozzle at a forward position and a rearward position of the foot assembly, wherein the suction nozzles are adjacent the steam distributors at the forward and rearward positions of the foot assembly.

DESCRIPTION OF THE PREFERRED EMBODIMENT

The invention relates to a surface cleaning apparatus that is capable of generating steam and applying that steam to the surface to be cleaned, which can include both carpeted and bare floor surfaces.

Figure 1:
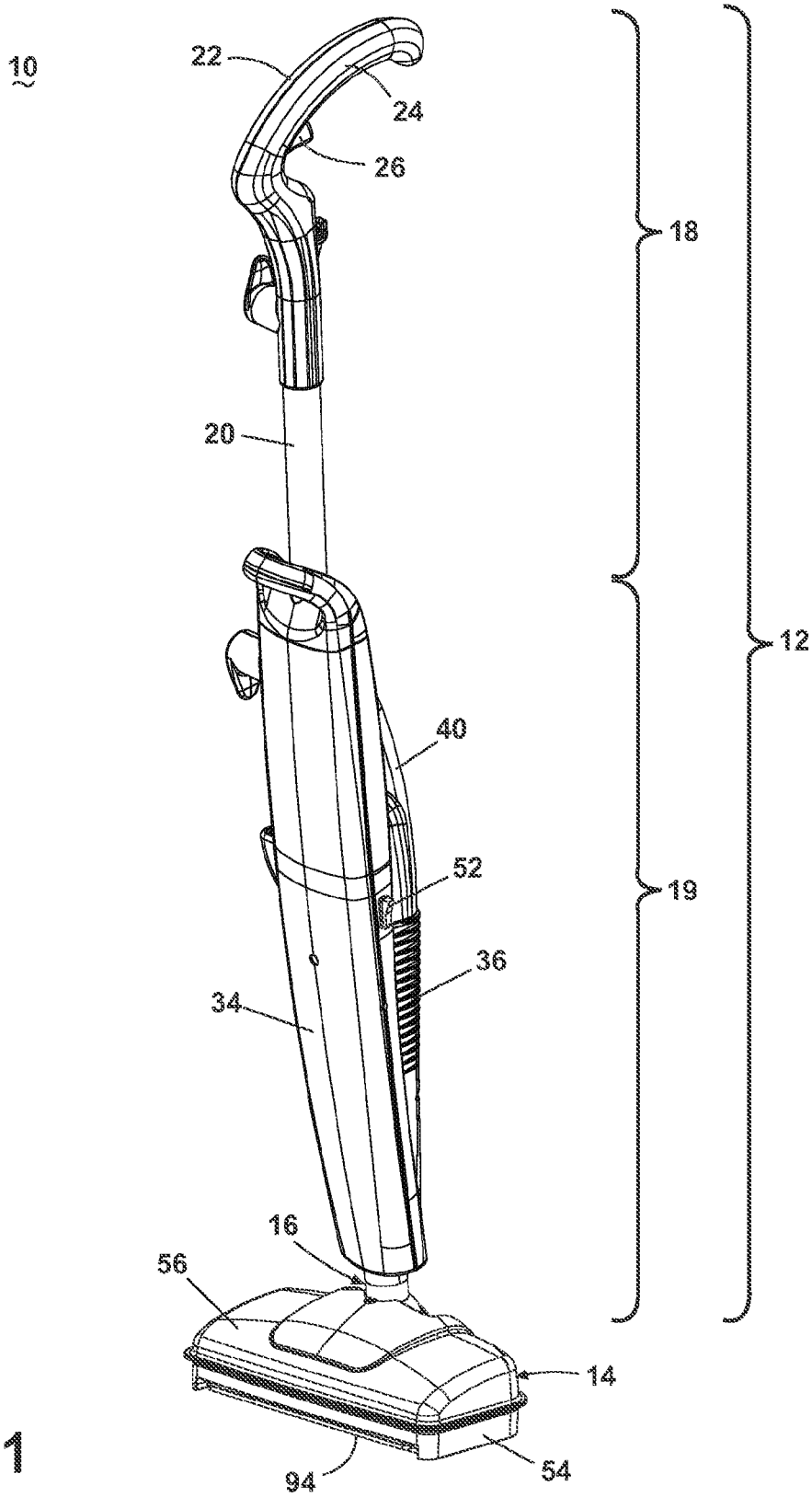
FIG. 1 is a front perspective view of an upright steam mop according to the invention.
Figure 2:
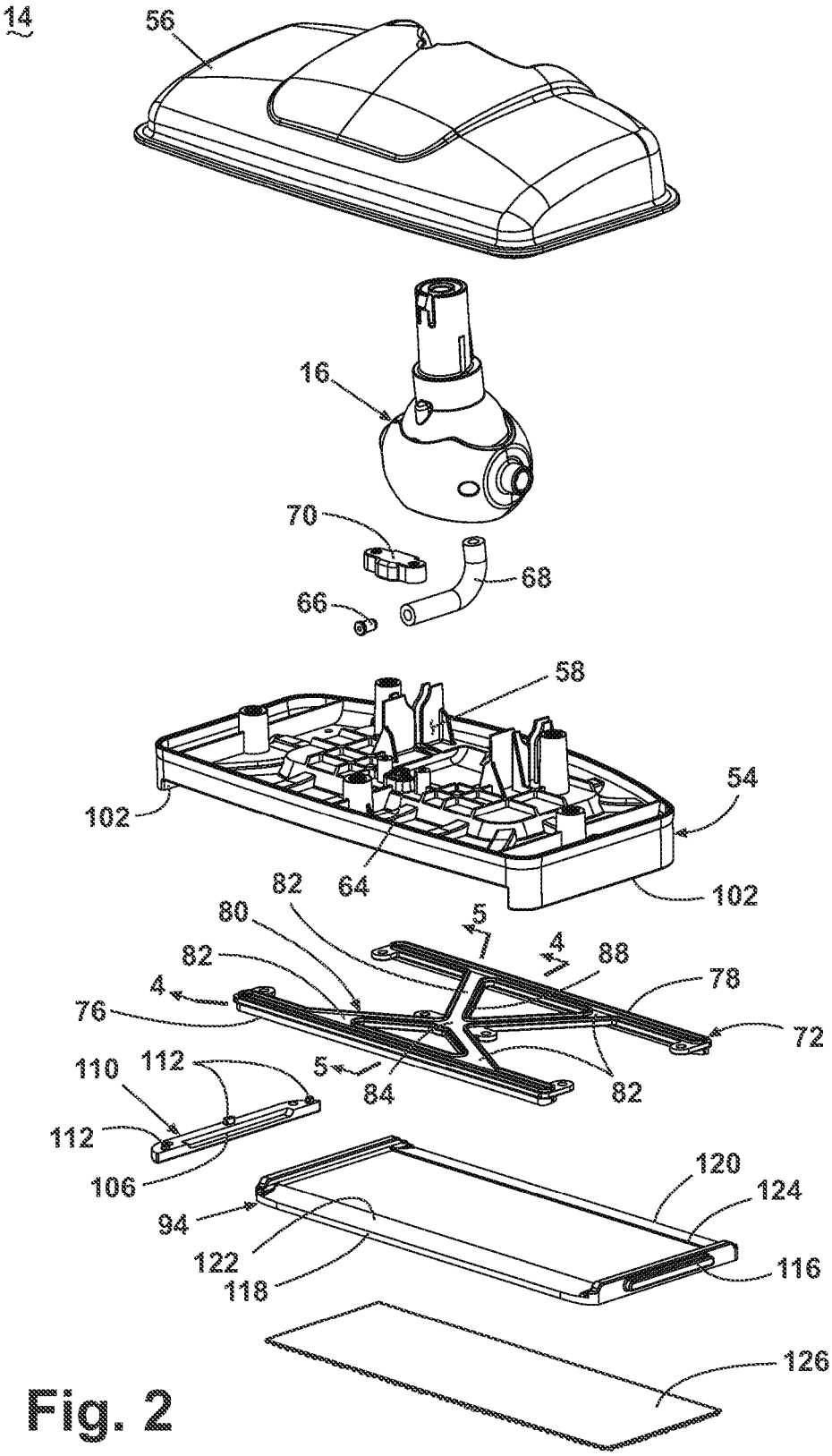
FIG. 2 is an exploded view of the foot assembly of the steam mop shown in FIG. 1.
Figure 3:
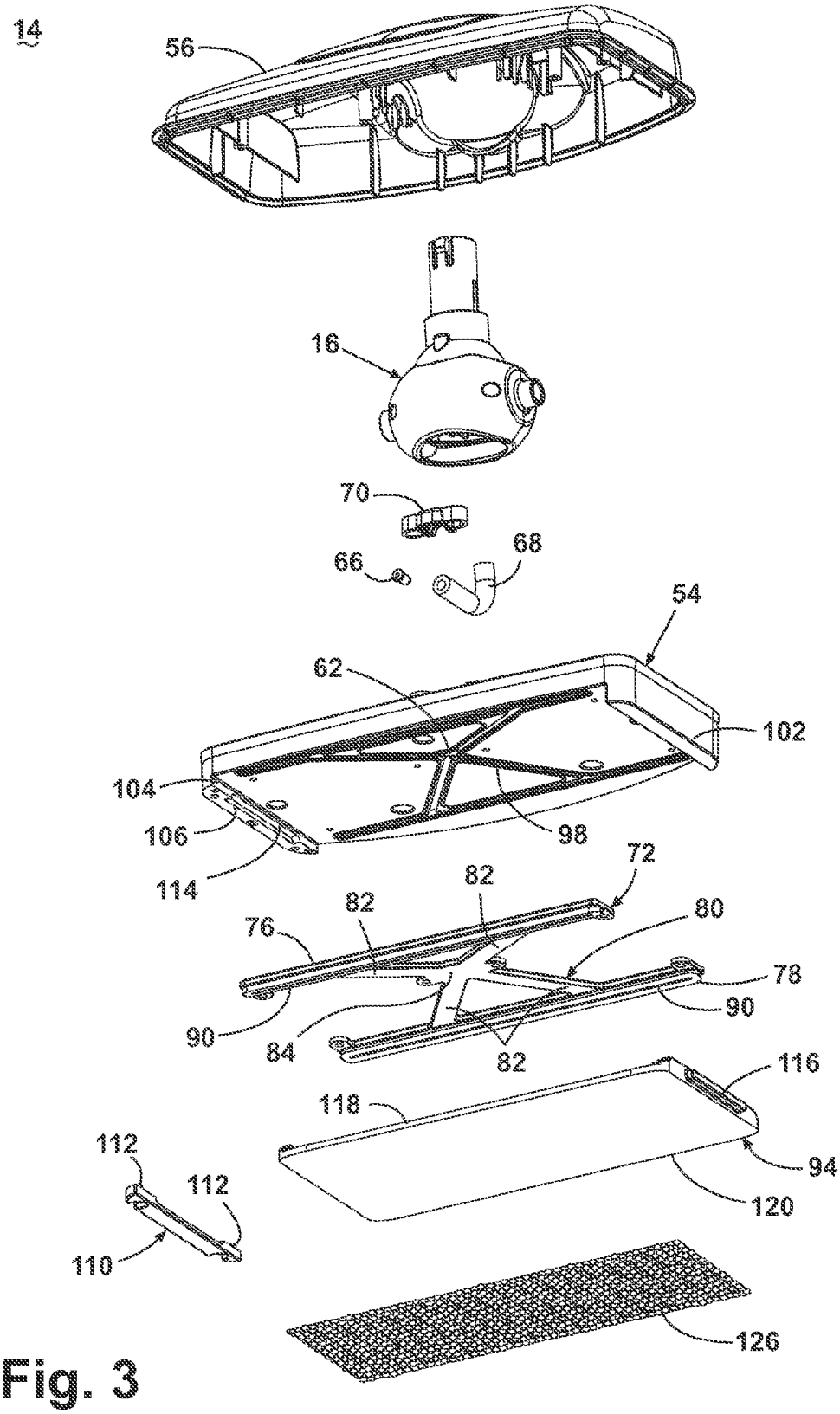
FIG. 3 is an exploded bottom perspective view of the foot assembly of the steam mop shown in FIG. 1.

Referring to the drawings, and in particular to FIGS. 1-3, a steam mop 10 according to the invention for cleaning hard floor surfaces, such as tile, linoleum, and wood, comprises a housing with an upright handle assembly 12 and a foot 14 swivelably mounted to the handle via a conventional universal joint 16. The foot 14 is adapted to glide across a cleaning surface and the handle 12 is configured to direct the foot 14 across the cleaning surface. The universal joint 16 permits the foot 14 to swivel multi-axially relative to the upright handle assembly 12.

The upright handle assembly 12 further comprises an upper handle assembly 18 and a lower handle assembly 19. The upper handle assembly 18 comprises a handle tube 20 connected to a handle grip 22 that is engagable by a user for manipulating the steam mop 10. The handle grip 22 is formed by two mating arcuate grip halves 24 that form a recess to receive a pivotally mounted trigger 26. The trigger 26 is adapted to rotate relative to the handle grip 22. When depressed, the trigger 26 selectively engages a micro-switch (not shown) that is operably connected to a steam delivery system mounted within the lower handle assembly 19.

The lower handle assembly 19 comprises elongated, mating front and rear enclosures 34, 36. The front enclosure 34 mates with the rear enclosure 36 and forms a central cavity (not shown) therebetween for mounting components of the steam delivery system. The steam delivery system comprises a fluid distribution system for storing a cleaning fluid, heating the fluid to generate steam, and a steam distributor for delivering the steam to the cleaning surface. The fluid distribution system comprises a fluid supply tank 40 adapted for fluid connection to a receiver (not shown) at the backside of the rear enclosure 36. The fluid supply tank 40 comprises an inlet and outlet (not shown) and is configured to hold a predetermined amount of liquid. In one embodiment, the liquid is water or electrolyzed water. Optionally, a variety of cleaning chemicals, fragrances, botanical oils, and the like can be mixed with the water. An optional filter module (not shown) can be detachably connected to the fluid supply tank 40 for removing impurities within the cleaning fluid. A conventional solenoid pump 44, heating element 46, and a pressure relief valve (not shown) are mounted within the central cavity (not shown) and fluidly connected via conventional tubing and fluid fittings therebetween.

A power switch 52 is mounted to the rear enclosure 36 and operably connects line electrical power to the steam delivery system via a power cord (not shown), thereby permitting a user to selectively energize the steam mop 10. The solenoid pump 44 is electrically connected to a micro-switch (not shown) that is operably connected to the trigger 26 mounted in the grip 22 portion. Alternatively, the solenoid pump 44 can be replaced by a valve (not shown) to permit liquid to flow from the fluid supply tank 40 into the heating element 46 and, subsequently, through the fluid distributor and onto the cleaning surface.

The foot 14 comprises a base 54 with a top cover 56 secured thereto with mechanical fasteners (not shown). The base 54 and top cover 56 form a mounting pocket 58 that receives the conventional swiveling universal joint 16 in a known manner. The universal joint connects the foot 14 to the upright handle assembly 12 and permits each assembly to swivel multi-axially with respect to the other. The base 54 comprises a generally planar member having conventional mounting bosses and structural ribbing extending upwardly therefrom. The base 54 further comprises a central aperture 62 surrounded by a cradle rib 64 that is configured to receive a nesting spray nozzle 66. The inlet side of the spray nozzle 66 is connected to a flexible tube 68 in fluid connection with the steam delivery system. Screw bosses on opposing sides of the cradle rib 64 mount a retainer 70, which is held in place via mechanical fasteners. The retainer 70 secures the spray nozzle 66 to the base 54 above the aperture, thereby creating a working fluid path from the steam delivery system to the bottom side of the base 54.

Figure 4:
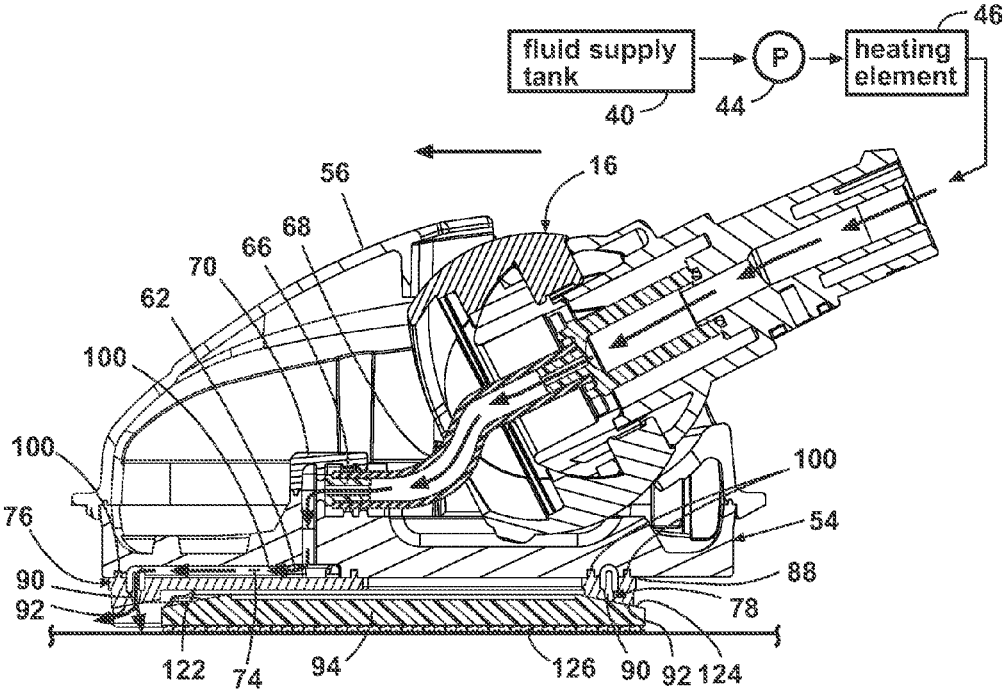
FIG. 4 is a cross-sectional view of the foot assembly of the steam mop shown in FIG. 2, taken along line 4-4 and showing the unit in a forward push stroke.
Figure 5:
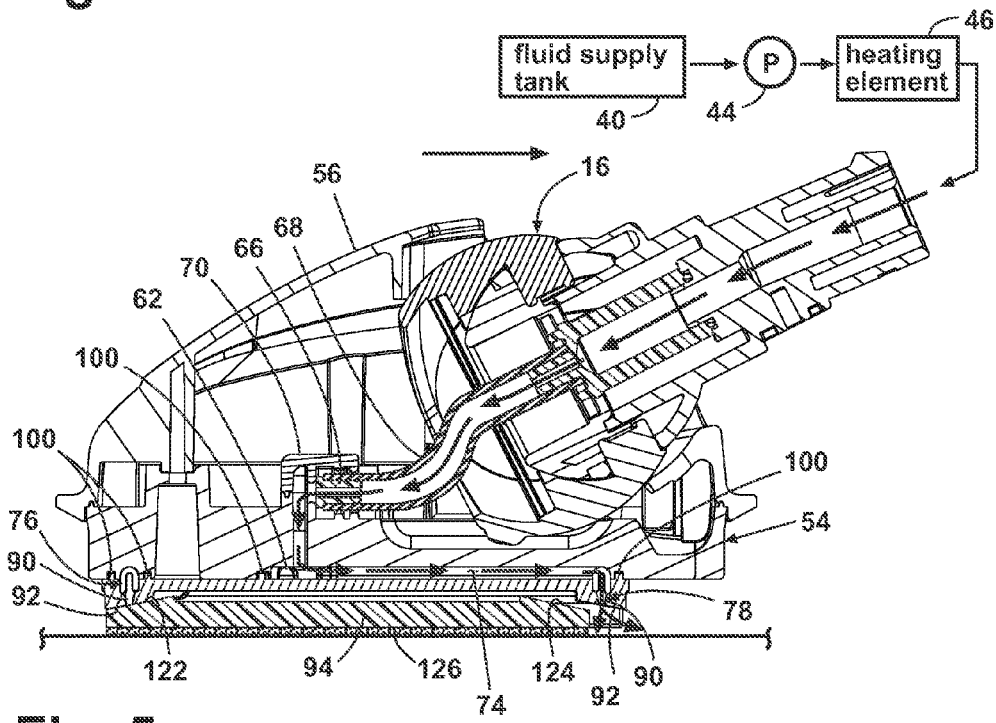
FIG. 5 is a cross-sectional view of the foot assembly of the steam mop shown in FIG. 2, taken along line 5-5 and showing the unit in a backward pull stroke.
Figure 6A:
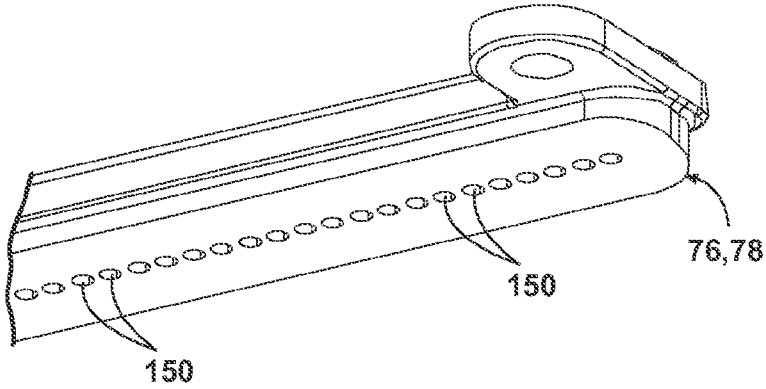
FIG. 6A is a detail view of a steam distributor of the steam mop shown in FIG. 1, illustrating small apertures.
Figure 6B:
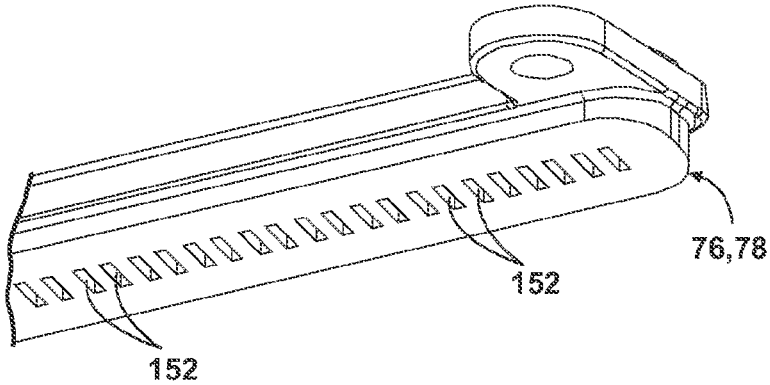
FIG. 6B is a detail view of the steam distributor of the steam mop shown in FIG. 1, illustrating small slit openings.
Figure 6C:
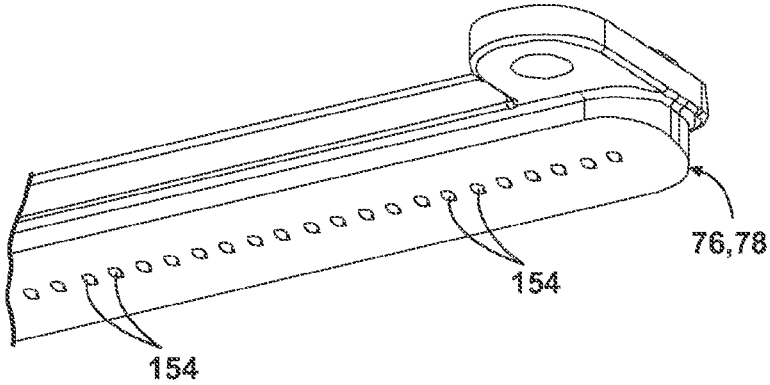
FIG. 6C is a detail view of the steam distributor of the steam mop shown in FIG. 1, illustrating cat-eye openings.
Figure 7A:
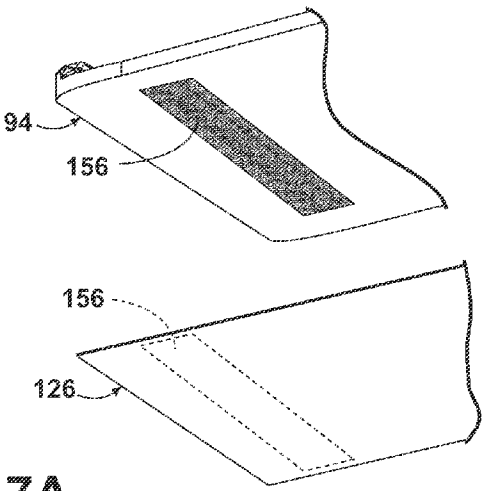
FIG. 7A is a detail view of a shuttle mop plate and a mop pad of the steam mop shown in FIG. 1, illustrating a hook and loop fastener attachment means.
Figure 7B:
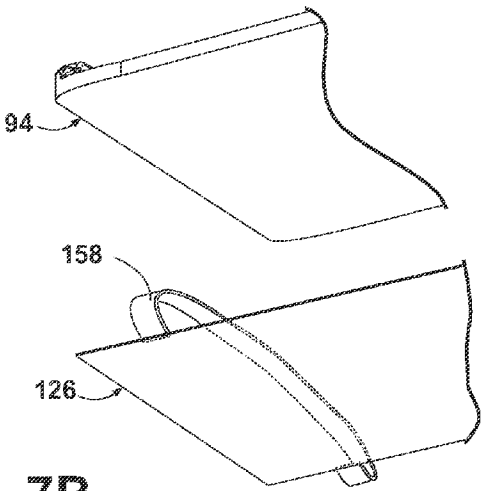
FIG. 7B is a detail view of the shuttle mop plate and the mop pad of the steam mop shown in FIG. 1, illustrating an elastic strap attachment means.
Figure 7C:
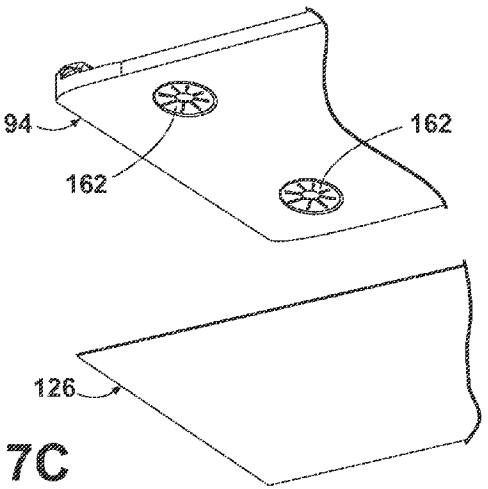
FIG. 7C is a detail view of the shuttle mop plate and the mop pad of the steam mop shown in FIG. 1, illustrating a resilient cloth engagement and retention members attachment means.
Figure 7D:
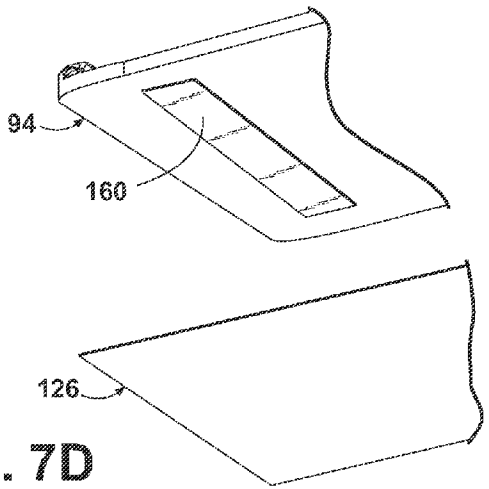
FIG. 7D is a detail view of the shuttle mop plate and the mop pad of the steam mop shown in FIG. 1, illustrating an adhesive strip attachment means.

Now referring to FIGS. 3-5, a steam manifold 72 is mounted beneath the base 54 in fluid communication with the central aperture 62 and spray nozzle 66. The steam manifold 72 is configured to form a sealed steam distribution path 74 to guide steam outwardly from the centrally located spray nozzle 66 towards the front and rear portions of the base 54. The manifold 72 further comprises a pair of steam distributors in the form of opposed, elongate forward and rearward steam distributors 76, 78 that are fluidly connected by an X-shaped channel 80. The X-shaped channel 80 comprises four individual channel legs 82 that radiate outwardly from a central channel portion 84, which is configured for alignment beneath the central aperture 62 and spray nozzle 66. Each channel leg 82 comprises a shallow U-shaped member having a bottom wall and opposed vertical sidewalls 88. As shown in FIGS. 3-5 and 6A-C, the steam distributors 76, 78 each comprise a narrow slit-opening 90, but can also optionally comprise a plurality of small apertures 150 or other suitable configurations, such as a plurality of small slits 152, cat-eye openings 154, or the like. Furthermore, the front and rear steam distributors 76, 78 each comprise a chamfered face 92 adapted to intermittently seal against a shuttling steam mop plate 94, which will be described hereinafter. The steam manifold 72 is secured beneath the base 54 with several mechanical fasteners (not shown), although sonic welding, adhesive, or other conventional attachment means that form a sealed steam distribution path 74 are also suitable. Vertical sidewalls 88 extend upwardly from the manifold edges. Each vertical sidewall 88 comprises a thin, stepped tongue portion 96 along the top edge that mates with an arcuate groove 98 formed in the bottom of the base 54. Upon assembly, a tongue and groove joint 100 is created between the base 54 and manifold 72, which prevents undesirable leaks along the steam distribution path 74.

The base 54 further comprises opposed support legs 102 that extend downwardly and form a recessed area therebetween adapted to receive the manifold 72 and a shuttle plate 94. Each support leg 102 comprises an inwardly facing planar wall 104 with a recessed horizontal guide track 106 defined by an indented pocket formed at least partially within the planar wall 104. The guide track 106 on the left side of the base 54 is formed entirely within the planar wall 104. The guide track 106 on the right side of the base 54 is split and is formed in part by each of the planar wall 104 and a mating detachable plate retainer 110. The detachable plate retainer 110 comprises spaced locator posts 112 that align the detachable plate retainer 110 on the bottom of the support leg 102 and mechanical fasteners (not shown) secure the plate retainer 110 to the base 54. The top face of each guide track 106 defines a sliding bearing surface 114.

The shuttle plate 94 comprises a generally flat rectangular member having a plate projection 116 extending outwardly from each of the opposed short sides. The slide plate projections 116 are adapted to be slidingly received within the guide tracks 106 to glidingly mount the mop plate 94 beneath the base 54. The side plate projections 116 and guide tracks 106 are sized with sufficient clearance to permit the mop plate 94 to freely slide forward and backward with respect to the base 54. Alternatively, separate bearings can be inserted between the slide plate projections 116 and the guide tracks 106 to enhance the sliding operation. Preferably, the slide plate projections 116 and guide tracks 106 (including the plate retainer 110) are molded out of thermoplastic materials having adequate lubricity and thermal/chemical resistance and can include, but is not limited to Polypropylene, Polyethylene, Nylon, or Acetal, for example. Additionally, various conventional lubricants can be applied between the plate projections 116 and the guide tracks 106 to ensure facile shuttling of the mop plate 94.

The shuttle plate 94 further comprises a front edge 118 and a rear edge 120, each edge 118, 120 comprising an upward facing chamfered sealing face 122, 124, respectively, that alternately seals against the corresponding front and rear chamfered faces 92, 93 of the steam distributors 76, 78 as the steam mop is maneuvered forward and backward across the cleaning surface. Additionally, the shuttle plate 94 is configured to receive a mop pad 126 for connection thereto. The mop pad 126 comprises a conventional microfiber fabric material. Alternatively, the pad 126 can comprise any number of commercially available disposable mop pads and cleaning sheets. As shown in FIGS. 7A-D, the attachment means for securing the mop pad 126 to the mop plate 94 can comprise any variety of conventional pad attachment means including, but not limited to traditional hook and loop fasteners 156, elastic straps 158, adhesive strips 160, or resilient cloth engagement and retention members 162 having a plurality of outwardly radiating slits as is commonly known in the art.

In operation, the steam mop 10 is prepared for use by filling the fluid supply tank 40 with liquid and mounting it to the receiver (not shown) on the rear enclosure 36. A user then energizes the steam mop 10 by plugging the power cord (not shown) into an electrical outlet and actuating the power switch 52. The user selectively depresses the trigger 26 while manipulating the steam mop over the surface to be cleaned. The trigger 26 actuates the solenoid pump 44, which pumps fluid into the steam delivery system. The heating element 46 heats the liquid to generate steam. Steam is pushed through the flexible tube 68 inside the universal joint 16 and through the spray nozzle 66 mounted to the base 54. The steam flows out of the spray nozzle 66 and into the steam manifold 72, where it flows outwardly from the central channel 84 through each of the radial channel legs 82, along the sealed steam distribution path 74. The steam flows to the front and rear steam distributors 76, 78 and flows through the slit opening 90 of either the front or rear chamfered face 92, 93 depending on the cleaning stroke direction. On a forward stroke (FIG. 4), a user pushes the steam mop 10 forward and friction between the cleaning surface and the mop pad 126 shuttles the mop plate 94 backwardly. The slide plate projections 116 on both sides of the mop plate 94 slide on the bearing surfaces 114 within the guide tracks 106 formed in each of the support legs 102 that extend downwardly from the base 54. As the rear edge of the mop plate 94 slides backward, the rear chamfered sealing face 124 seals against the mating chamfered face 93 of the rear steam distributors 78, thus blocking the slit opening 90 of the rear steam distributors 78 and preventing steam from flowing therethrough. When the mop plate 94 is in the rearmost position, the front chamfered sealing face 122 is spaced behind the corresponding chamfered face of the front distributors 92, thus unblocking the slit opening 90 therein and permitting steam to flow through the slit 90 and onto the cleaning surface at the front edge of the mop pad 126. On a backstroke (FIG. 5), the user pulls the steam mop 10 backward and friction between the mop pad 126 and the cleaning surface shuttles the mop plate 94 forwardly. The plate projections 116 slide forward on the bearing surfaces 114 within the guide tracks 106. The front chamfered sealing face 122 seals against the mating chamfered face 92 of the front steam distributors 76, thus blocking steam from flowing through the slit opening 90. When the mop plate 94 is in the forward-most position, the rear chamfered sealing face 124 is spaced apart from the corresponding rear chamfered face 93 of the rear distributors 78, thus unblocking the slit opening 90 therein and permitting steam distribution on the cleaning surface at the leading edge of the mop pad 126. Accordingly, selectively distributing steam along the leading edge of the mop pad 126 prevents oversaturation of the pad, thus prolonging useful pad life between launderings.

Figure 8:
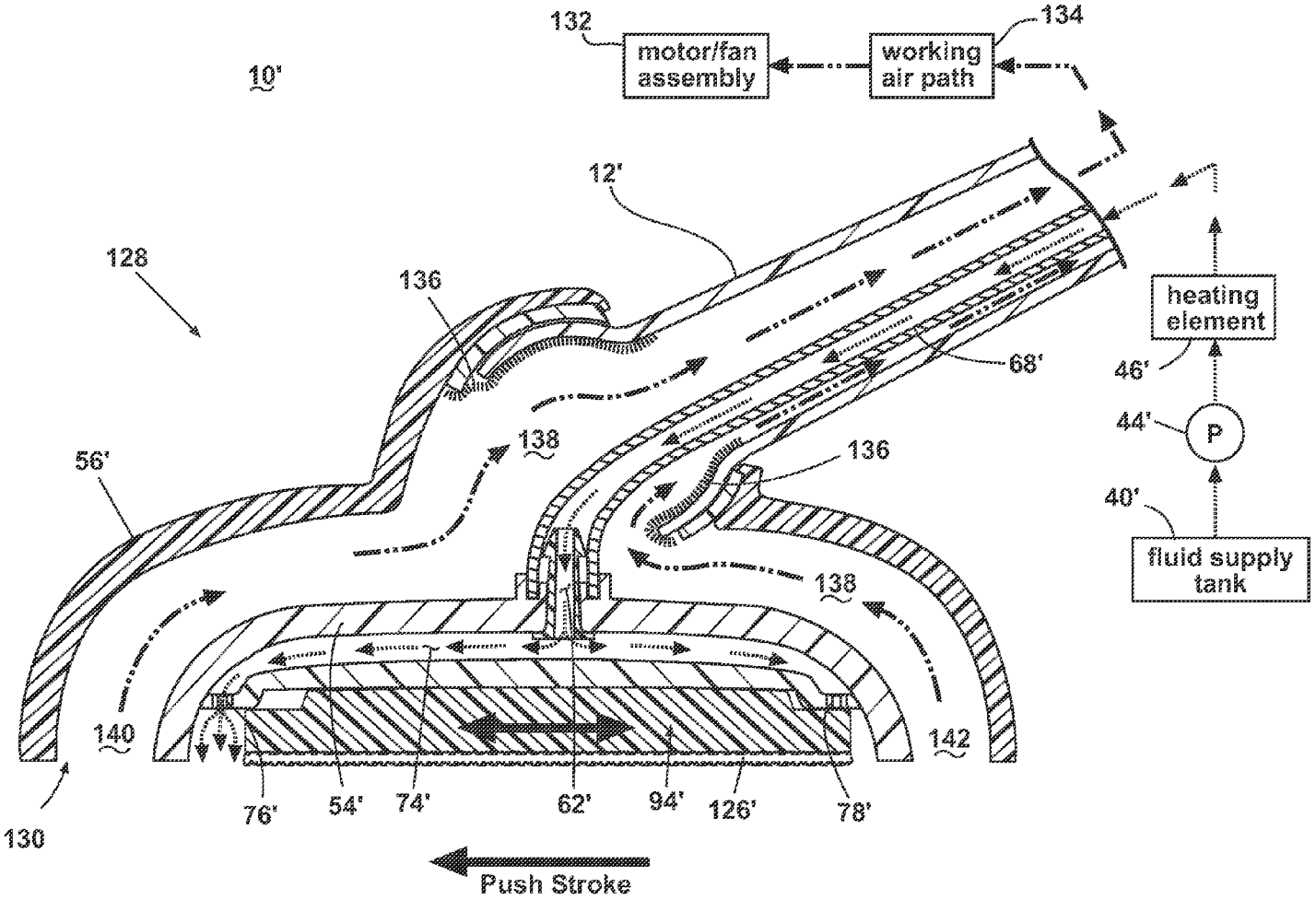
FIG. 8 is a schematic view of a steam mop according to a second embodiment of the invention and shown in a forward push stroke.

Now referring to FIG. 8, which shows a schematic depiction of a second embodiment of the invention in which like elements from the previous embodiment are identified with the same reference numerals and include a prime (') symbol. A steam mop vacuum 10' comprises an upright handle assembly 12', a steam delivery system as previously disclosed, and further comprises a vacuum system. The vacuum system comprises a conventional vacuum source for generating a working airstream to draw dust and debris from a surface to be cleaned through a working air path that includes a main filtration or separation assembly for separating and collecting debris. Main filtration assemblies in conventional vacuum cleaners typically comprise a conventional bag filter or a cyclone separator assembly, both of which are well-known in the art. The steam mop vacuum 10' further comprises a steam vacuum foot 128 comprising a suction nozzle 130 surrounding front and rear steam distributors 76', 78' that are configured to be selectively blocked by a shuttle plate 94' that is slidably mounted beneath the base 54'. Thus, the steam mop vacuum 10' is configured to perform simultaneous vacuuming and steam mopping functions for improved bare floor cleaning.

For simplicity, FIG. 8 includes a schematic depiction of the vacuum system. A vacuum motor/fan assembly 132 and working air path 134 in the upright handle assembly 12' are fluidly connected to a suction nozzle 130 in the steam vacuum foot 128 via a flexible conduit 136 that extends through the universal joint 16' that connects the upright handle assembly 12' to the steam vacuum foot 128 for swivel movement in known fashion. The suction nozzle 130 comprises a bifurcated suction flow path 138 extending bi-directionally from the flexible conduit 136 outwardly toward the front and rear edges of the steam vacuum foot 128. The flow path 138 is formed between a vertically spaced top cover 56' and the base 54'. The bifurcated flow path 138 terminates at front and rear suction inlets 140, 142 positioned near the cleaning surface and oriented transversely along the front and rear sides of the steam vacuum foot 128 to straddle the front and rear elongate steam distributors 76', 78'.

In operation, the steam mop vacuum 10' is prepared for use as previously described except that the vacuum motor/fan assembly 132 is energized simultaneously with the steam delivery system when the power cord is plugged into an electrical outlet and the power switch 52' (not shown) is actuated. Upon being energized, the vacuum motor/fan assembly 132 generates a working airflow that is drawn in through the front and rear inlets 140, 142 at the front and rear edges of the steam vacuum foot 128 and flows into the bifurcated flow path 138, through the flexible conduit 136, into a main filtration assembly where dust/debris is separated and collected, before entering the vacuum motor/fan assembly 132 and is finally exhausted through the motor/fan assembly 132 through vent holes (not shown) in the front and rear enclosures 34', 36' (not shown) to the atmosphere, as is commonly known in the art. The steam delivery system, including the shuttle plate 94', is configured to intermittently block rear and front steam distributors 76', 78' on push and pull strokes respectively as previously described. Optionally, although not shown in FIG. 8, the base 54' and shuttle plate 94' can be configured such that the mop plate 94' intermittently blocks the front or rear steam distributors 76', 78' and the corresponding front or rear suction inlets 140, 142 simultaneously. In this alternate configuration, steam and suction are present only at the leading edge of the mop plate 94'. As shown in FIG. 8, because the suction inlets 140, 142 straddle the front and rear elongate steam distributors 76', 78', suction is continuously present at the leading edge of the shuttle plate 94' and attached mop pad 126' regardless of whether the steam vacuum 10' is pushed in a forward stroke or pulled in a backstroke. Applying continuous suction along the leading and trailing edges of the mop pad 126' prevents excessive soiling of the mop pad during use. Furthermore, selectively distributing steam along the leading edge of the mop pad 126' prevents oversaturation of the pad. Thus, the steam vacuum foot 128 described herein can prolong useful mop pad life.

While the invention has been specifically described in connection with certain specific embodiments thereof, it is to be understood that this description is by way of illustration and not of limitation, and the scope of the appended claims should be construed as broadly as the prior art will permit. Reasonable variation and modification are possible within the foregoing specification and drawings without departing from the spirit of the invention, which is set forth in the accompanying claims.

What is claimed is:

1. A surface cleaning apparatus comprising:

a foot assembly for movement along a surface to be cleaned;

a handle assembly mounted to the foot assembly;

a steam delivery system mounted at least in part to the foot assembly and including a steam generator and a forward and a rearward steam distributor connected to the steam generator, wherein the forward and rearward steam distributors are positioned at a forward portion and a rearward portion, respectively, of the foot assembly; and a shuttle plate mounted to the foot assembly for reciprocal movement between a forward position in registry with the forward steam distributor and a rearward position in registry with the rear steam distributor on an underside of the foot assembly, wherein the shuttle plate is configured to close off the forward steam distributor at the forward position and to close off the rearward steam distributor when the shuttle plate is in the rearward position, wherein the rearward steam distributor is open when the shuttle plate is in the forward position and the forward steam distributor is open when the shuttle plate is in the rearward position.

2. The surface cleaner according to claim 1 wherein the handle assembly is swivelably mounted to the foot assembly.

3. The surface cleaner according to claim 1 wherein the steam delivery system further comprises a fluid supply tank fluidly connected to the steam generator for supplying cleaning fluid to the steam generator.

4. The surface cleaner according to claim 1 wherein the forward and rearward steam distributors extend across at least a substantial lateral portion of the foot assembly.

5. The surface cleaner according to claim 4 wherein the steam distributors comprise one of a narrow slit-opening, a plurality of small apertures or slits and cat-eye openings.

6. The surface cleaner according to claim 4 wherein the steam distributor forms a portion of a manifold that has a central opening that is connected to the steam generator, the manifold has an X-shaped channel fluidly connecting the central opening to the forward and rearward steam distributors.

7. The surface cleaner according to claim 1 and further comprising a cleaning implement removably mounted to the shuttle plate.

8. The surface cleaner according to claim 7 wherein the cleaning implement is one of a mop cloth, scrubbing pad, scrub brush, or cleaning sheet.

9. The surface cleaner according to claim 7 wherein one of the cleaning implement and the shuttle plate comprise a one of a hook and loop fasteners, elastic straps, adhesive strips, resilient cloth engagement and retention members having radiating slits for removably attaching the cleaning implement to the surface cleaner.

10. The surface cleaner according to claim 1 wherein the shuttle plate has a pair of outwardly extending projections and the foot assembly has a pair of guide tracks in which the projections are glidingly received.

11. The surface cleaner according to claim 1 and further comprising a vacuum source mounted to at least one of the foot assembly and the handle assembly, wherein the foot assembly includes at least one suction nozzle connected to the vacuum source and adapted to contact the surface to be cleaned and to draw moisture and debris from the surface.

12. The surface cleaner according to claim 11 wherein the at least one suction nozzle includes a suction nozzle at a forward position and at a rearward position of the foot assembly.

13. The surface cleaner according to claim 12 and wherein one of the suction nozzles is adjacent the forward steam distributor and another of the suction nozzles is adjacent the rearward steam distributor.

* * * * *